United States Patent [19]

Ravid

[11] Patent Number: 4,750,268

[45] Date of Patent: Jun. 14, 1988

[54] DIRECT READING OUTSEAM TAPE

[76] Inventor: Albert J. Ravid, 1342 Monroe, River Forest, Ill. 60305

[21] Appl. No.: 39,315

[22] Filed: Apr. 16, 1987

[51] Int. Cl.[4] ..... A41H 1/00

[52] U.S. Cl. ..... 33/2 H; 33/2 R; 33/512

[58] Field of Search ..... 33/137 R, 2 H, 2 R, 33/2 A, 512

[56] References Cited

U.S. PATENT DOCUMENTS

| | | | |
|---|---|---|---|
| 1,612,637 | 12/1926 | Mesteron | 33/2 R |
| 2,711,587 | 6/1955 | Branman | 33/2 H |
| 3,088,208 | 5/1963 | Mitchell | 33/2 H |

*Primary Examiner*—William D. Martin, Jr.

*Attorney, Agent, or Firm*—Lockwood, Alex, FitzGibbon & Cumming

[57] ABSTRACT

A tape measure device by which a salesperson can obtain a direct outseam measurement to be used by a tailor in shortening the legs of pants or slacks without having to take an inseam measurement. The device has a rigid tab at one end on which a standing customer being measured places her or his shoe heel. The salesperson then extends the tape to the customers waistband and reads the outseam measurement at that point which can be used to shorten the legs of the garment with the hems of the legs being at the desired predetermined height. By providing another rigid tab on the opposite end and placing additional indicia on the opposite side of the tape the utility of the device can be expanded to making other body measurements.

1 Claim, 2 Drawing Sheets

DIRECT READING OUTSEAM TAPE

This invention relates primarily to a tape measure device by which a salesperson can obtain direct outseam measurement that can be used in shortening the legs of a pair of pants or slacks without having to take an inseam measurement. Certain embodiments of the invention can be used to make various additional measurements.

Traditionally, when a man or boy was being fitted with a new pair of pants or trousers, the salesman would use a tape measure to make an inseam measurement extending from the crotch to the place on the pant leg where the hem at the bottom of the pant legs would be at the desired height. In recent times, the taking of inseam measurements has become undesirable in certain situations. For example, if the person being fitted for a pair of pants or slacks is of a different sex from that of the salesperson. Further, in order to make an inseam measurement the salesperson has to stoop or reach down to adjacent the ankle of the person being fitted and this may be undesirable and physically difficult for some salespersons.

In view of the foregoing, the object of the invention, generally stated, is the provision of a tape measure device whereby the taking of an inseam measurement is eliminated and it is only necessary for a standing salesperson to take a measurement reading on a tape measure at a position which is level with the top of the waistband of the trousers or slacks that are being fitted.

A further and important object of the invention is the provision of a tape measure device by means of which a salesperson can arrive at the proper inseam length of the legs of a pair of pants or slacks to be worn by either a huge male or tiny female without taking an inseam measurement.

Still another important object of the invention is the provision of a tape measure device which can be conveniently used by a salesperson of either sex in taking an outseam measurement of a person being fitted of either sex by making one use of the tape measure device and which by making use of another side and another end of the tape measure device can be used to measure neck, chest, waist sizes and sleeve lengths.

Certain other important objects will be apparent to those skilled in the art from the following detailed description of a preferred embodiment of the invention taken in connection with the accompanying drawings wherein.

Figure 1:
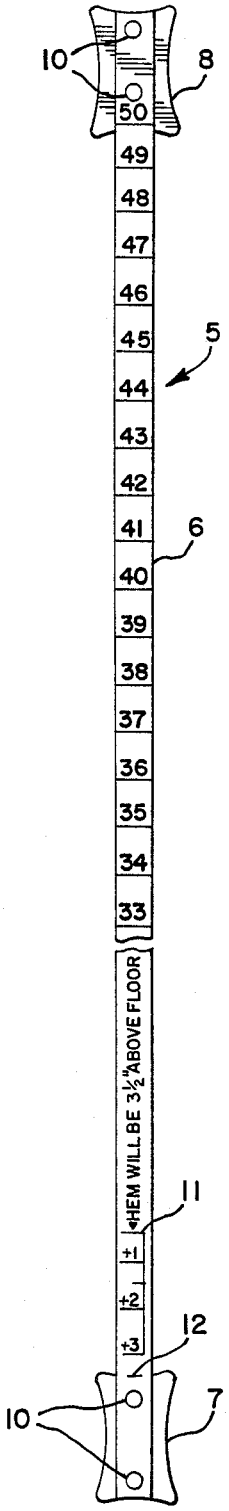
FIG. 1 is an elevational view of a tape measure device embodying the invention and showing the indicia on one side of the flexible tape portion used to measure the outseam for a pair of pants or trousers being fitted.
Figure 2:
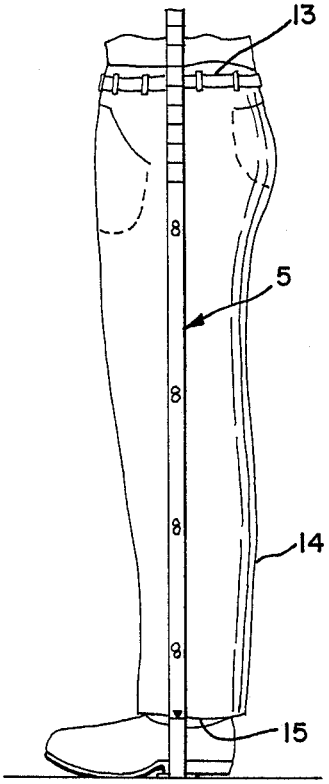
FIG. 2 is a fragmentary side elevational view illustrating the manner in which the tape measure device shown in FIG. 1 is used to take an outseam measurement which can be used in shortening the wearer's pants or slacks to the proper leg length.

Referring to FIGS. 1 and 2, a tape measure device is indicated generally at 5 comprising a tape measure 6 that may be formed of any suitable flexible material such as cloth, paper or plastic with rigid tab or flap members 7 and 8 attached to opposite ends by eyelet rivets 10—10 or other suitable means.

In FIG. 1 the side of the tape is shown which carries indicia which extends upwardly from 33 inches at the bottom to 50 inches at the top. The beginning or "zero" for the indicia shown in FIG. 1 actually starts at the line designated at 11. The line 11 is normally 3½ inches from a line 12 which is the hinge line between the rigid flap or tab 7 and the tape 6. The distance or measurement 3½ inches above the floor is the normal distance at which a pant or trouser leg will not "break" on the instep of a person wearing shoes which have heels of normal height.

The tape measure device 5 permits a salesperson to readily take the outseam measurement of a customer in the manner illustrated in FIG. 2. The flap or tab 7 is turned inwardly at right angles along the line 12 so that the side of the tab 7 shown in FIG. 1 engages the floor surface. The customer or person being fitted stands on the opposite side of the flap 7 with the surface of the heel of his or her shoe engaging the flap or tab 7, as shown in FIG. 2. The salesperson then extends the tape measure 6 upwardly along the side of the body of the person being fitted to the top of the belt of waistband 13. This measurement will provide an outseam measurement that can be used in shortening the pant leg 14. This same measurement can also be used in fitting the customer from stock of pants or slacks that have already been hemmed. For example, assume that the outseam measurement taken with the tape measure 5 in FIG. 2 is 40 inches. If the tailor or person shortening the pant leg uses this measurement and places the resulting hem of the pant leg a distance equal to the outseam measurement (i.e. 40 inches from the top of the waistband 13) the hem line indicated at 15 in FIG. 2 will be 3½ inches above the floor line. If a particular customer desires a "break" in his or her pants or slacks legs then the hem line 15 will be adjusted by being made, for example, ½ inch longer (i.e. lower) than the outseam measurement obtained. Conversely, if the customer prefers to have the pant legs somewhat shorter (i.e. higher) then the hem 15 will be raised a suitable distance such as ½ inch.

In use, by suspending the tape measure 6 from adjacent its upper end and allowing the end flap 7 to rest flatwise against the floor, the customer can then readily place his or her heel on the appropriate surface of the end flap 7 and the salesperson then can take the outseam measurement as shown in FIG. 2 with the tape measure 6 in a taut condition. Thus, neither the customer nor the salesperson has to stoop down in order to place the end flap 7 in the proper position and there is no need for physical contact between the salesperson and the customer in making the outseam measurement.

The end flaps 7 and 8 can be formed with any desirable stiff material such as pressed board, plastic, metal, or laminations.

Figure 1A:
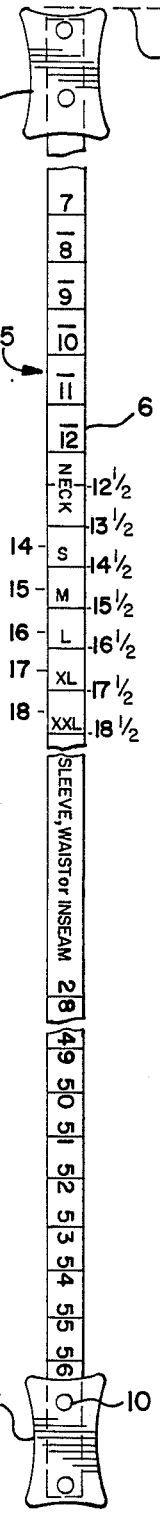
FIG. 1A is an elevational view of the opposite side of the tape measure device shown in FIG. 1.

The side of the tape 6 opposite to the side shown in FIG. 1 is shown in FIG. 1A and the indicia thereon allows the tape measure device 5 to be used for making additional body measurements that will be useful. For the indicia shown in FIG. 1A the zero or starting line is at the outer end of the tab or flap 8 as indicated at 16.

Figure 4:
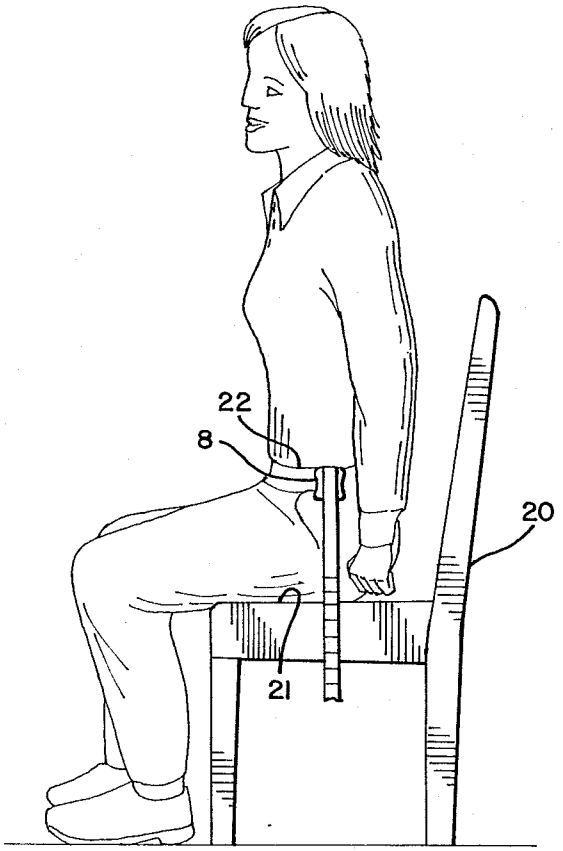
FIG. 4 is a perspective view showing the person in FIG. 3 now seated on a chair and having a second measurement taken which can be utilized with the measurement taken in FIG. 3 to obtain a correct inseam measurement.
Figure 3:
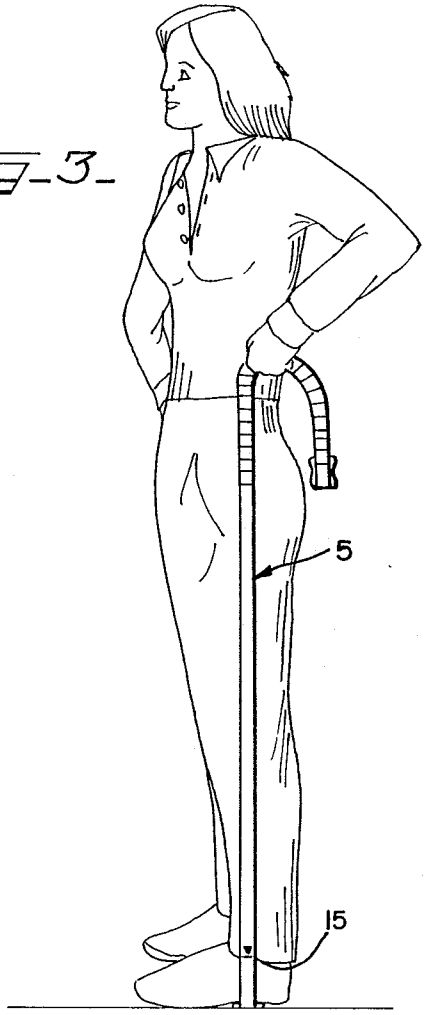
FIG. 3 is a perspective view of a female of small stature having an outseam measurement taken using the tape measure device of FIG. 1.

It has been found in fitting a huge male or tiny female with pants or slacks that the preferred procedure entails use of both sides of the tape measure device 5 as illustrated in FIGS. 3 and 4. First, the tape measure device 5 is used to make an outseam measurement in the same manner that it was used and described above in connection with FIG. 2. Once taken this initial measurement is taken and noted, the customer is seated on a hard surface such as the chair indicated at 20. Then, using the end of the tape measure device 5 having the flap or tab 8 and the side of the tape shown in FIG. 1A, a measurement is taken from the top of the waist 22 to the seat surface 21 (usually between 7–12 inches). By deducting this latter measurement between lines 21 and 22 (FIG. 4) from the previous outseam measurement, the difference gives the inseam measurement for use in shortening or adjusting the length of the legs of a pair of pants or slacks for an oversized or huge male or a diminutive or tiny female.

The first indicia shown in FIG. 1A has additional uses. One is for taking neck size measurements starting with 12½ inches for boys and running from small (S) through medium (M), large (L), extra large (XL), to extra extra large (XXL). Actually, the S mark of line is 14½ inches from the line 16 and the lines for M, L, XL and XXL are approximately 1 inch apart.

Downwardly from the neck size indicia the indicia for sleeve, waist, inseam and chest measurements commence at the 28 inch mark and extend out to the 56 inch mark.

It will be obvious how the tape measure 5 can be used to take neck, sleeve, waist, inseam and chest measurements using the rigid flap or tab 8 and the side of the tape 6 shown in FIG. 1A. In taking such measurements, the tape measure 5 would be utilized in the ordinary or conventional manner.

What is claimed is:

1. A tape measure device for use by a salesperson in obtaining a direct outseam measurement that can be used to shorten the legs of pants and slacks without having to take an inseam measurement, said device comprising a tape having a first rigid member attached to one end on which a person being fitted stands with one shoe, said tape having first indicia on one side thereof covering in upward reading increments of length from said first rigid member the normal range of distance between the top of the waistband and the desired hem on the adjacent leg of the pants or slacks, a second rigid member attached to said tape on the end thereof opposite said one end, and second indicia on the side of said tape opposite said one side comprising increments of length reading from said second rigid member for use in making neck, sleeve, waist and chest measurements and a measurement from the top of the waistband of a seated person to the seat surface which last-mentioned measurement when subtracted from the outseam measurement of said seated person when standing yields a difference which is usable as the inseam measurement particularly of a tiny female or a huge male.

* * * * *